US009517825B1

(12) United States Patent
Anschuetz et al.

(10) Patent No.: US 9,517,825 B1
(45) Date of Patent: Dec. 13, 2016

(54) SYSTEMS AND METHODS FOR POSITIONING A MARINE PROPULSION DEVICE TO PREVENT HYDRO-LOCK OF A MARINE PROPULSION ENGINE

(71) Applicant: Brunswick Corporation, Lake Forest, IL (US)

(72) Inventors: Steven M. Anschuetz, Fond du Lac, WI (US); Aaron K. Saltsman, Campbellsport, WI (US); Steven J. Andrasko, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 14/844,196

(22) Filed: Sep. 3, 2015

Related U.S. Application Data

(60) Provisional application No. 62/183,402, filed on Jun. 23, 2015.

(51) Int. Cl.
*B63H 20/10* (2006.01)

(52) U.S. Cl.
CPC ..... *B63H 20/10* (2013.01)

(58) Field of Classification Search
CPC ..... B63H 20/10; B63H 20/00
USPC ..... 701/21
See application file for complete search history.

(56) References Cited

U.S. PATENT DOCUMENTS 4,050,359 A 9/1977 Mayer
4,318,699 A 3/1982 Wenstadt et al.
4,794,820 A 1/1989 Floeter
4,842,559 A * 6/1989 Litjens ..... B63H 21/265 440/1
5,067,919 A * 11/1991 Okita ..... B63H 21/265 440/61 C
6,022,254 A 2/2000 Neisen
6,414,607 B1 7/2002 Gonring
6,571,753 B1 6/2003 Jaeger
6,638,124 B2 10/2003 Zoubul et al.
6,704,643 B1 3/2004 Suhre
7,416,456 B1 8/2008 Gonring et al.
8,317,557 B2 11/2012 Dudarenke et al.
(Continued)

OTHER PUBLICATIONS

Mercury Marine, JPO Service Manual 90-8M0076286, Theory of Operation, Auto Trim Portion, Jul. 2013, p. 2A-5.
(Continued)

*Primary Examiner* — Brian P Sweeney
(74) *Attorney, Agent, or Firm* — Andrus Intellectual Property Law, LLP

(57) ABSTRACT

A method and system position a marine propulsion device with respect to a transom of a marine vessel to which it is coupled. A controller determines whether an actual speed representing a speed of the vessel or a speed of an engine powering the propulsion device is greater than a given speed and whether a transmission of the propulsion device is in forward gear, and if so, sets a trim control unit of the controller to a ready state. If the transmission is shifted out of forward gear while the trim control unit is in the ready state, the controller sets the trim control unit to an active state. The controller determines whether an actual trim position of the propulsion device is less than a target trim position while the trim control unit is in the active state, and if so, sends a signal to trim the propulsion device up.

20 Claims, 4 Drawing Sheets

(56) References Cited

U.S. PATENT DOCUMENTS

| | | | |
|---|---|---|---|
| 8,540,536 | B1 | 9/2013 | Eichinger |
| 8,651,908 | B1 | 2/2014 | Glodowski et al. |

OTHER PUBLICATIONS

Mercury Marine, JPO Owners Manual 90-8M0081623, Section 2—On the Water, Auto Trim Portion, May 2013, p. 21.

Ritger et al., Drivetrain and Transmission for Marine Propulsion Device for Preventing Engine Ingestion of Water, Unpublished U.S. Appl. No. 14/590,360, filed Jan. 6, 2015.

* cited by examiner

SYSTEMS AND METHODS FOR POSITIONING A MARINE PROPULSION DEVICE TO PREVENT HYDRO-LOCK OF A MARINE PROPULSION ENGINE

CROSS-REFERENCE TO RELATED APPLICATION

The present application claims the benefit of U.S. Provisional Application Ser. No. 62/183,402, filed Jun. 23, 2015, which is hereby incorporated by reference herein.

FIELD

The present disclosure relates to systems and methods for positioning marine propulsion devices with respect to a transom of a marine vessel to which they are coupled.

BACKGROUND

The following U.S. Patents and Applications are incorporated herein by reference.

U.S. Pat. No. 4,050,359 discloses a hydraulic system for a combined power trim and shock absorbing piston-cylinder unit of an outboard motor that includes a reversible pump means having a trim-up port connected by a pressure responsive pilot valve piston cylinder units and a trim-down port through a reverse lock solenoid valve and a down-pilot spool valve providing full drain flow for trim-up and power flow for trim-down. An "up-reverse" pilot valve with a pressure operator is in parallel with the reverse lock valve and provides a restricted by-pass for limited trim-up in reverse. The trim-up hydraulic input or powered side of the cylinder units define a trapped hydraulic system creating "memory" in the system so after impact the motor returns to the original trim position. The return side permits relatively free-flow to permit "trail-out" under low impact. At high speed impact, the flow is restricted and cylinder pressure increases. At a selected point, a shock valve within the piston-cylinder opens and absorbs the shock forces. The piston unit includes an inner floating head telescoped into a head secured to the piston rod with a chamber thereby formed to store the liquid flow during shock movement. A metered orifice and check valve allows return to the original trim-set position.

U.S. Pat. No. 6,414,607 discloses a throttle position sensor that is provided with a plurality of sensing elements which allow the throttle position sensor to provide a high resolution output to measure the physical position of a manually movable member, such as a throttle handle, more accurately than would otherwise be possible. The plurality of sensors significantly increases the redundancy of the sensor and allows its operation even if one of the sensing elements is disabled.

U.S. Pat. No. 6,704,643 discloses a calibration procedure that involves the steps of manually placing a throttle handle in five preselected positions that correspond with mechanical detents of the throttle control mechanism. At each of the five positions, one or more position indicating signals are received by a microprocessor of a controller and stored for future use. The five positions comprise wide open throttle in forward gear, wide open throttle in reverse gear, the shift position between neutral and forward gear, the shift position between neutral and reverse gear, and the mid-point of the neutral gear selection range. The procedure includes continuously monitoring signals provided by a sensor of the throttle control mechanism and mathematically determines the precise position of the throttle handle as a function of the stored position indicating signals. In one embodiment, each position indicating signal comprises three redundant signal magnitudes.

Unpublished U.S. patent application Ser. No. 14/590,360, filed Jan. 6, 2015, discloses a drivetrain for a marine propulsion device that includes an engine driving a crankshaft in a first direction, and a driveshaft connected in torque-transmitting relationship with the crankshaft and supported for rotation about a driveshaft axis. The drivetrain further includes a propeller shaft rotatable about a propeller shaft axis. A gearset and a selector clutch are configured to couple the propeller shaft and the driveshaft to each other in torque-transmitting relationship. A one-way clutch is disposed along the drivetrain upstream of the gearset. The one-way clutch prevents rotation of the crankshaft in a second, opposite direction so as to prevent ingestion of water by the engine via an engine exhaust system.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

One example of the present disclosure is a method for positioning a marine propulsion device with respect to a transom of a marine vessel to which it is coupled. The method includes determining with a controller whether an actual speed representing one of a speed of the vessel and a speed of an engine powering the propulsion device is greater than a given speed and whether a transmission of the propulsion device is in a forward gear, and if so, setting a trim control unit of the controller to a ready state. The method also includes determining with the controller whether the transmission has been shifted out of the forward gear while the trim control unit is in the ready state, and if so, setting the trim control unit to an active state. The method also includes determining with the controller whether an actual trim position of the propulsion device is less than a target trim position while the trim control unit is in the active state, and if so, sending a signal with the controller to trim the propulsion device up.

Another example of the present disclosure is of a system for positioning a marine propulsion device with respect to a transom of a marine vessel to which it is coupled. A trim device has a first end coupled to the propulsion device and a second end coupled to the transom, the trim device being extendible and retractable to trim the propulsion device up and down with respect to the transom. A speed sensor senses an actual speed representing one of a speed of the vessel and a speed of an engine powering the propulsion device. A shift sensor senses a gear state of a transmission of the propulsion device and a trim sensor senses an actual trim position of the propulsion device. A controller is in signal communication with the trim device, the speed sensor, the shift sensor, and the trim sensor, and has a trim control unit controlling extension and retraction of the trim device. The controller determines whether the actual speed is greater than a given speed and whether the transmission is in a forward gear, and if so, sets the trim control unit to a ready state. The controller then determines if the transmission has been shifted out of the forward gear while the trim control unit is in the ready state, and if so, sets the trim control unit to an active state. The controller then determines whether the actual trim position is less than a target trim position while the trim control unit is in the active state, and if so, sends a signal to the trim device to trim the propulsion device up.

BRIEF DESCRIPTION OF THE DRAWINGS

The present disclosure is described with reference to the following Figures. The same numbers are used throughout the Figures to reference like features and like components.

DETAILED DESCRIPTION

In the present description, certain terms have been used for brevity, clarity and understanding. No unnecessary limitations are to be inferred therefrom beyond the requirement of the prior art because such terms are used for descriptive purposes only and are intended to be broadly construed.

Those skilled in the art of marine vessels and their propulsion and control systems are familiar with many different devices that allow the operator of a marine vessel to select a transmission gear position and engine operating speed. Typically this control is performed through the use of a throttle lever, or handle, which allows the operator to select an engine operating speed and gear position. The gear positions typically include forward, neutral, and reverse gears, and the engine operating speed can be selected between wide open throttle (WOT) in forward gear position and wide open throttle in reverse gear position. Some traditional throttle levers use push-pull cables that allow the operator of the marine vessel to mechanically move a throttle control mechanism and a gear selection mechanism associated with the one or more marine propulsion devices used on the marine vessel. These marine propulsion devices can be outboard motors, stemdrives, or any other suitable type of device. More recently, digital throttle and shift (DTS) systems have been developed which allow the throttle handle to be electrically connected to the throttle mechanism and gear selection mechanism without the need for actual cables to be extended between the helm and the marine propulsion devices. Certain types of control systems for marine vessels use a controller area network (CAN) bus to transmit commands between the throttle lever at the helm and the actual mechanisms which control the throttle position on the engine and the transmission.

Figure 1:
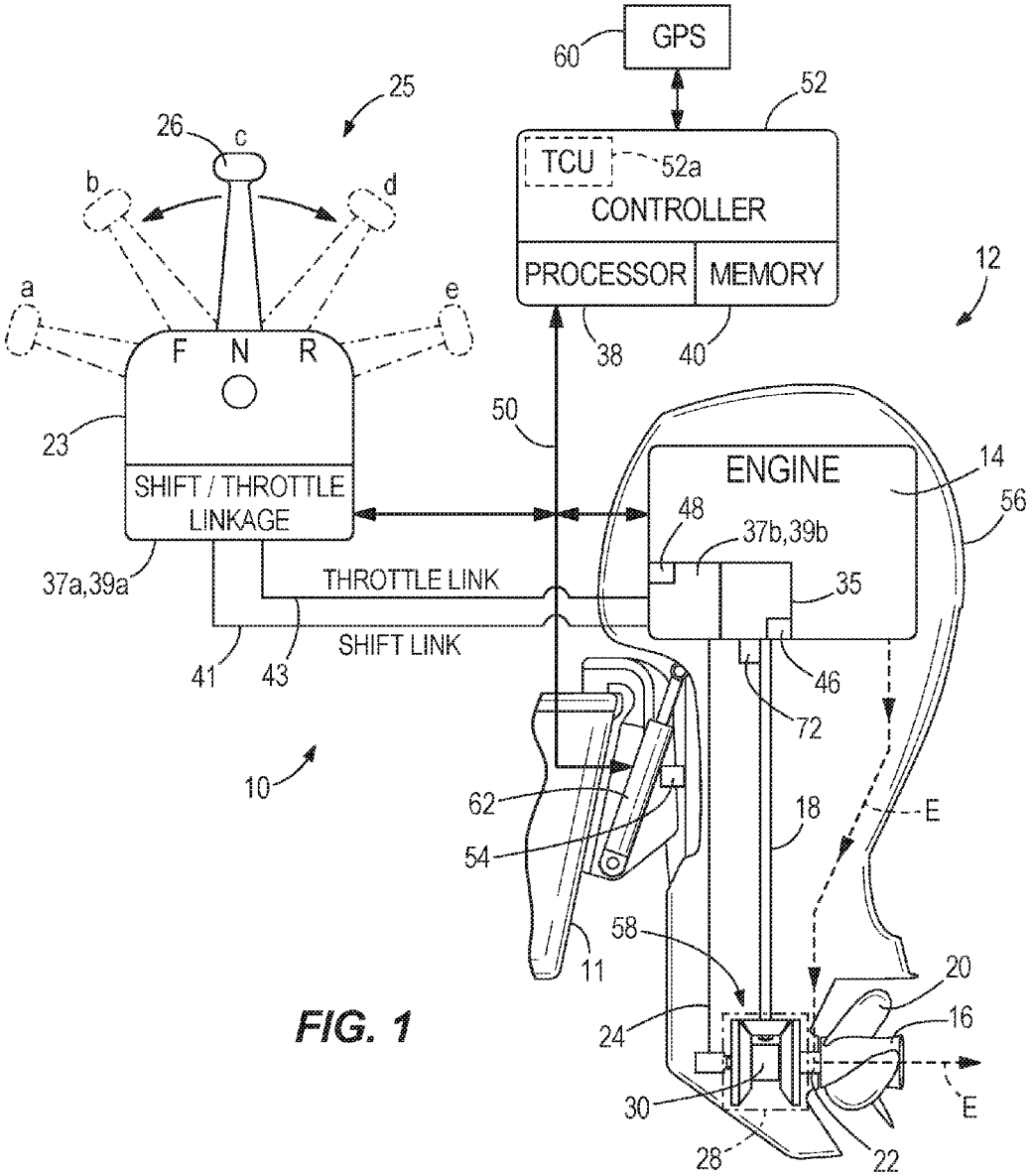
FIG. 1 illustrates a schematic of one example of a marine propulsion device and a throttle/shift system according to the present disclosure.

FIG. 1 shows a marine propulsion device control system 10 including a remote control 25 having a combination shift/throttle control lever 26 that is pivotally movable between a reverse wide open throttle position 26*e*, a reverse detent position 26*d*, a neutral position 26*c*, a forward detent position 26*b* and a forward wide open throttle position 26*a*, as is conventional. The remote control 25 is typically located at the helm of a marine vessel, of which the transom is shown at 11. The control lever 26 is operably connected to a shift linkage 37 and a throttle linkage 39, such that pivoting movement of the control lever 26 can cause corresponding movement of the shift linkage 37 and such that pivoting movement of the control lever 26 can cause corresponding movement of the throttle linkage 39. Portions 37*a* of the shift linkage 37 are typically located at the remote control 25 and other portions 37*b* of the shift linkage 37 are located at the engine 14. Similarly, portions 39*a* of the throttle linkage 39 are typically located at the remote control 25 and other portions 39*b* of the throttle linkage 39 are located at the engine 14. The shift linkage 37 also includes a shift link 41 that translates movement of the control lever 26 to the marine propulsion device 12, and ultimately to the shift rod 24, for causing a shift event (i.e., a change in gear) in the clutch located at gearset 28. The shift link 41 can be for example a cable and/or the like. The throttle linkage 39 includes a throttle link 43 that translates movement of the control lever 26 to the engine 14 of the marine propulsion device 12, and ultimately to change the position of a throttle valve 35 of the engine 14. The throttle link 43 can be for example a cable and/or the like.

The control system 10 also includes a controller 52 that is programmable and includes a microprocessor 38 and a memory 40. The controller 52 can be located anywhere in the control system 10 and/or located remote from the control system 10 and can communicate with various components of the marine vessel via wired and/or wireless links, as will be explained further herein below. Although FIG. 1 shows a single controller 52, the control system 10 can include more than one controller 52. For example, the control system 10 can have a controller 52 located at or near the control lever 26 and can also have a controller 52 located at or near the marine propulsion device 12. Each controller 52 can have one or more control sections or control units. One having ordinary skill in the art will recognize that the controller 52 can have many different forms and is not limited to the example that is shown and described.

In some examples, the controller 52 may include a computing system that includes a processing system, storage system, software, and input/output (I/O) interfaces for communicating with devices such as the engine 14, the remote control 25, a global positioning system (GPS) 60, a trim device 62, and/or various other sensors to be described herein below. The processing system loads and executes software from the storage system, such as software programmed with a trim control method. When executed by the computing system, trim control software directs the processing system to operate as described herein below in further detail to execute the trim control method. In the example shown herein, the controller 52 includes a trim control unit 52*a* for carrying out the specific method described herein. However, it should be understood that a specifically-designated trim control unit 52*a* need not be provided, and the trim control software could be stored and executed by a control unit that carries out functions other than just trim control.

The computing system may include one or many application modules and one or more processors, which may be communicatively connected. The processing system can comprise a microprocessor (e.g., processor 38) and other circuitry that retrieves and executes software from the storage system. Processing system can be implemented within a single processing device but can also be distributed across multiple processing devices or sub-systems that cooperate in existing program instructions. Non-limiting examples of the processing system include general purpose central processing units, applications specific processors, and logic devices.

The storage system (e.g., memory 40) can comprise any storage media readable by the processing system and capable of storing software. The storage system can include volatile and non-volatile, removable and non-removable media implemented in any method or technology for storage of information, such as computer readable instructions, data structures, program modules, or other data. The storage system can be implemented as a single storage device or across multiple storage devices or sub-systems. The storage system can further include additional elements, such as a controller capable of communicating with the processing system. Non-limiting examples of storage media include random access memory, read only memory, magnetic discs, optical discs, flash memory, virtual memory, and non-virtual memory, magnetic sets, magnetic tape, magnetic disc storage or other magnetic storage devices, or any other medium which can be used to store the desired information and that may be accessed by an instruction execution system. The storage media can be a non-transitory or a transitory storage media.

In this example, the controller 52 communicates with one or more components of the marine propulsion device 12 via a communication link 50, which can be a wired or wireless link. The controller 52 is capable of monitoring and controlling one or more operational characteristics of the marine propulsion device 12 and its various subsystems by sending and receiving control signals via the communication link 50. In one example, the communication link 50 is a controller area network (CAN) bus, but other types of links could be used. It should be noted that the extent of connections of the communication link 50 shown herein is for schematic purposes only, and the communication link 50 in fact provides communication between the controller 52 and each of the sensors, devices, and various subsystems described herein, although not every connection is shown in the drawings for purposes of clarity.

In this example, a throttle valve 35 is provided on the engine 14 and a throttle valve position sensor 46 senses the position of the throttle valve 35, which is movable between open and closed positions. The throttle valve position sensor 46 provides signals to the controller 52 via the communication link 50 indicating the current position of the throttle valve 35. The controller 52 is also configured to at least receive position signals from a shift sensor 48 sensing a current position of the shift linkage 37*b*. The controller 52 communicates with the shift sensor 48 via the communication link 50. In this example, the shift sensor 48 includes a potentiometer and an electronic converter, such as an analog to digital converter that outputs discrete analog to digital (ADC) counts that each represent a position of the shift linkage 37*b*. Such potentiometer and electronic converter combinations are known in the art and commercially available for example available from CTS Corporation.

It should be noted that the present methods are also intended to be used in connection with digital throttle and shift (DTS) systems, in which throttle and shift signals are sent electronically to the engine 14 and propulsion device 12. In this case, a potentiometer (or similar) would be provided in the base 23 of the remote control 25 to sense a position of the control lever 26. This position would be converted to a digital signal that would be sent via an electrical wire or wires to the engine 14 and propulsion device 12 (perhaps having their own ECU separate from the controller 52) to cause a motor or similar actuator to move the throttle valve 35 and/or shift rod 24 as appropriate. In this case, the shift sensor 48 could be provided at the remote control 25, and could use a position of the control lever 26 as signifying a gear state of a transmission of the propulsion device 12. DTS systems are well known to those having ordinary skill in the art and therefore will not be described further herein. Additionally, it should also be understood that the present systems and methods could be implemented on a stemdrive, and the depiction and description of an outboard motor herein is not limiting on the scope of the present disclosure.

Still with reference to FIG. 1, propulsion device 12 includes a driveshaft 18 driven by the engine 14 in a known manner. The driveshaft 18 transmits torque in one direction or another to a propeller shaft 22 by way of a gearset 28, as will be described further herein below. The propeller shaft 22 is surrounded at one end by a propeller hub 16 having a propeller 20 attached thereto. The gearset 28 and a selector clutch 30 are configured to couple the propeller shaft 22 and the driveshaft 18 to each other in torque-transmitting relationship. Together, the gearset 28 and selector clutch 30 make up a portion of a transmission 58 of the propulsion device 12.

Those having ordinary skill in the art will recognize that after the engine 14 combusts a fuel/air mixture, exhaust from such combustion is expelled from the engine's cylinders through an exhaust manifold of the engine 14 and thereafter routed through an exhaust system (not shown) to the propeller hub 16. The exhaust is then expelled from the propeller hub 16 and into the water in which the propulsion device 12 is operating, as shown schematically by dashed line labeled E. One example of an exhaust system for a sterndrive is found in U.S. Pat. No. 6,022,254, which is hereby incorporated by reference. One example of an exhaust system for an outboard motor is provided in U.S. Pat. No. 8,540,536, which is hereby incorporated by reference. Such exhaust systems are therefore known to those having ordinary skill in the art and therefore will not be discussed further herein.

Figure 2:
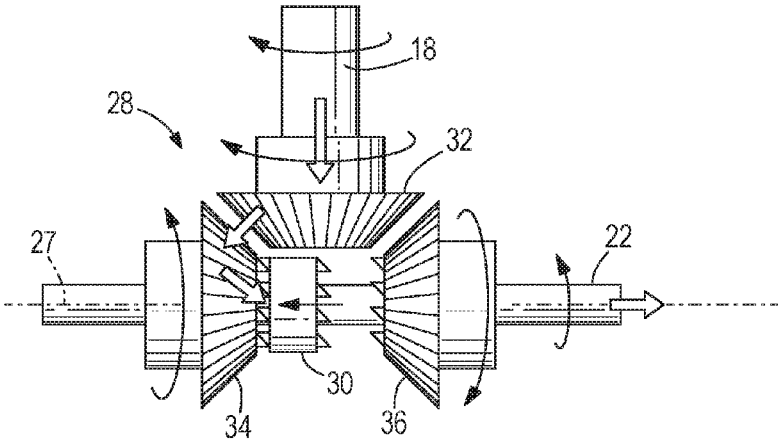
FIG. 2 illustrates one example of a gearset of a marine propulsion device operating in a first gear.
Figure 3:
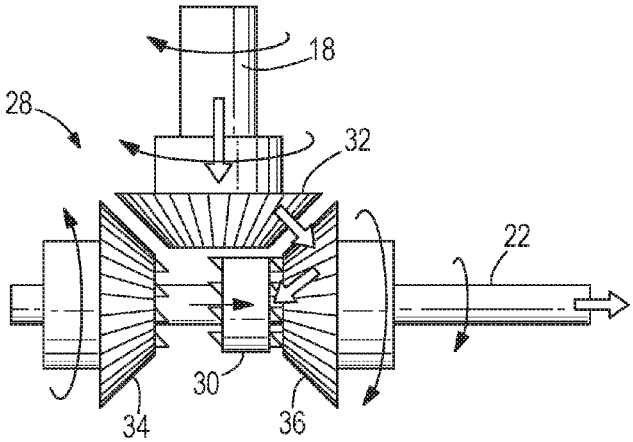
FIG. 3 illustrates the gearset of FIG. 2 operating in a second gear.

One example of a conventional gearset 28 is shown in FIGS. 2-3. A drive gear 32 is attached for rotation with the driveshaft 18. A forward gear 34 and a reverse gear 36 are disposed for rotation about a propeller shaft axis 27. (It should be understood that which gear provides forward or reverse movement of the marine vessel to which the marine propulsion device 12 is attached depends on the direction the driveshaft 18 is turning, as well as the pitch of the propeller 20, and the gears have been herein designated as "forward" and "reverse" for purposes of illustration only.) The forward and reverse gears 34, 36 are disposed in meshing relation with the drive gear 32 for rotation in opposite directions from each other about the propeller shaft axis 27. Each of the gears 32, 34, 36 are shown spaced slightly apart for the purpose of clearly distinguishing the components from one another; however, in operation the bevel gears 32, 34, 36 are disposed in continuous meshing association with each other.

It can be seen that rotation of the drive gear 32 by the driveshaft 18 causes continual rotation of both the forward gear 34 and reverse gear 36. The forward and reverse gears 34, 36 rotate in opposite directions, as illustrated by the arrows. A selector clutch 30, shown herein as a dog clutch, but which could be any other type of clutch known to those having ordinary skill in the art for similar purposes, is movable in an axial direction along the propeller shaft axis 27 (horizontal in FIGS. 2-3) between the forward and reverse gears 34, 36. The selector clutch 30 is attached for rotation with the propeller shaft 22 about the propeller shaft axis 27 and is movable between the forward and reverse gears 34, 36 so as to mesh with one of the forward and reverse gears 34, 36. The selector clutch 30 may be coupled in threaded association with the propeller shaft 22 through a set of straight splines, in a manner that is well-known to those skilled in the art of marine transmissions.

FIG. 2 shows the gearset 28 with the selector clutch 30 moved toward the left to engage its teeth with the teeth of the forward gear 34. This engagement of the clutch teeth with the gear teeth causes the selector clutch 30 to rotate in unison with the forward gear 34. Because the selector clutch 30 is associated in threaded engagement with the propeller shaft 22, the propeller shaft 22 rotates in unison with the forward gear 34 and the selector clutch 30. The rotational arrows indicate that the propeller shaft 22 rotates in the same direction (clockwise around the propeller shaft axis 27 when viewed from the rear) as the forward gear 34.

FIG. 3 illustrates the opposite condition, in which the selector clutch 30 is moved to the right and into tooth engagement association with the reverse gear 36. As a result, the selector clutch 30 rotates in unison with the reverse gear 36, and because of the straight spline connection between the selector clutch 30 and the propeller shaft 22, the propeller shaft 22 also rotates in unison with the reverse gear 36 in a counterclockwise direction around the propeller shaft axis 27.

If the selector clutch 30 is between (i.e., not meshed with) the forward and reverse gears 34, 36, then neither the forward gear 34 nor the reverse gear 36 is rigidly attached to the propeller shaft 22. As a result, the forward and reverse gears 34, 36 rotate about the propeller shaft axis 27 without affecting rotation of the propeller shaft 22. This occurs when the transmission 58 is in neutral.

When an operator of the marine vessel slows down the marine vessel very quickly, water moving by the propeller 20 sometimes causes the propeller 20 to spin at a speed that exceeds the rotational speed of the engine 14. In other words, the propeller 20 and associated propeller shaft 22 spin faster than the driveshaft 18 and faster than the engine's crankshaft. This is fine under certain circumstances. However, an undesirable situation occurs when the propulsion device's transmission 58 is shifted into reverse while the marine vessel is still moving forward in the water (sometimes called a "panic shift" because this maneuver is executed when an operator sees something ahead in the water he cannot avoid and quickly shifts the control lever 26 from forward, to neutral, to reverse). In this case, if the water is moving by the propeller 20 fast enough, torque from the propeller shaft 22 created by the still forward-spinning propeller 20 may cause the driveshaft 18 and crankshaft to slow to a no-rotation condition, and eventually to rotate in an opposite direction than normal, which causes the engine cylinders to act as pumps. The pumping action of the cylinders creates a vacuum, and water flows backwards through the exhaust system via the propeller hub 16. This causes the engine 14 to ingest water, which is very harmful for the engine 14 because it creates a hydro-lock of the pistons in the cylinders on the next rotation when the valves are closed.

Figure 4:
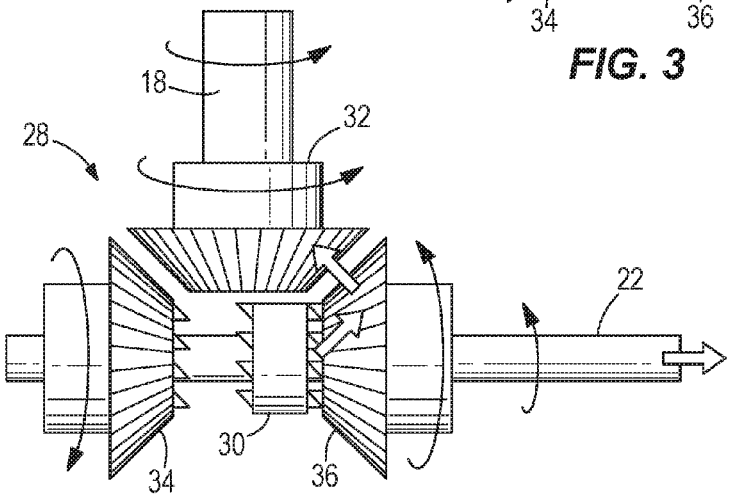
FIG. 4 illustrates the gearset of FIGS. 2 and 3 being rotated in a reverse direction due to a load from water acting on a propeller coupled to the gearset.

An illustration of the above-described situation is discussed with reference to FIG. 4. Assuming that the marine vessel has just been very quickly slowed from a high speed, the propeller 20 and propeller shaft 22 will still be rotating in a forward direction, as shown by the clockwise arrow (compare FIG. 2). This rotation is due to drag loads imposed by water W (see FIG. 5) acting on the propeller 20. If clockwise torque on the propeller shaft 22 due to the water W rotating the propeller 20 overcomes the torque produced by the engine 14 (which is transferred from the driveshaft 18 to the drive gear 32, and in a counterclockwise direction to the reverse gear 36, selector clutch 30, and propeller shaft 22), this causes the attached selector clutch 30 to rotate in the same direction (clockwise) as the propeller shaft 22. Because the selector clutch 30 has now been meshed with the reverse gear 36 due to the operator's "reverse" command, this also rotates the reverse gear 36 in the same direction (clockwise) as the propeller shaft 22. The tooth engagement of the reverse gear 36 with the drive gear 32 then causes the drive gear 32, and thus the driveshaft 18, to rotate in a direction opposite than normal. This same opposite rotation is transferred to the crankshaft and back-drives the engine 14 when torque on the drive gear 32 is greater than torque on the crankshaft, which is likely when the engines has just been slowed from high speed to low speed due to the operator's forward-to-neutral-to-reverse shift command input via the remote control 25.

Some solutions to panic shift maneuvers are available for DTS systems, such as a hold-in-gear timer used to allow the boat to slow down before it can be shifted into reverse. However, this solution does not work for mechanically-linked systems, such as that shown in FIG. 1. Some manufacturers used a blow-off valve to vent the exhaust E and prevent water ingestion in the event that the engine 14 begins spinning backwards. However, with the rise of automatic trim (auto-trim) systems, the present inventors realized that auto-trim concepts could be applied to address the problem of hydro-lock in the event of a panic shift. It should be noted, however, that the present methods can be implemented without requiring a full auto-trim system to be installed or activated. Further, the present methods can be implemented on both mechanical and DTS systems.

Figure 5:
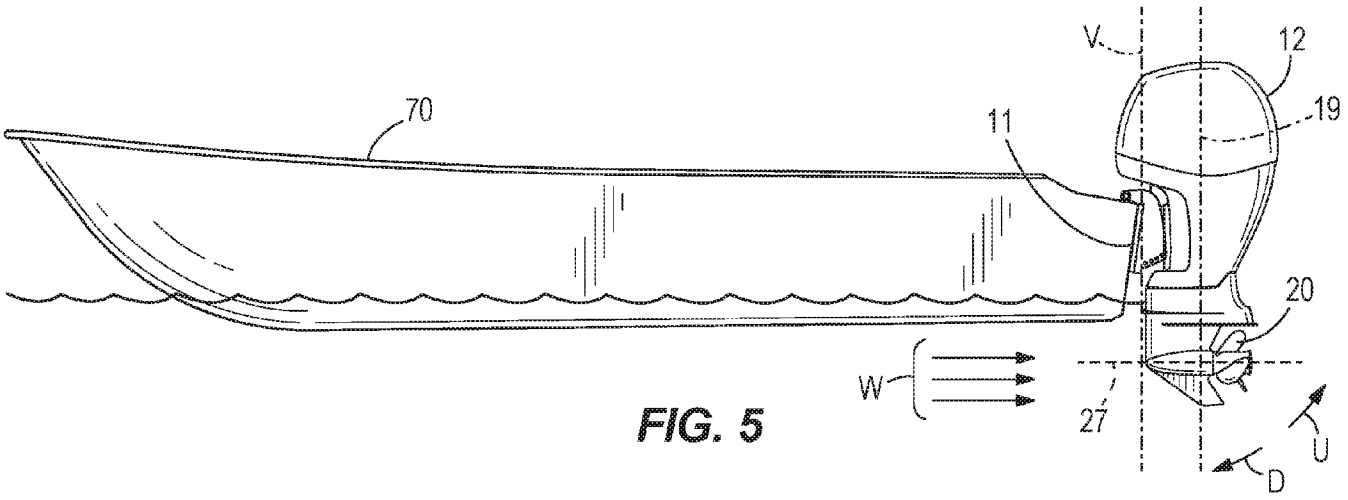
FIG. 5 illustrates a marine vessel with a propulsion device in a vertical trim position.

FIG. 5 shows the propulsion device 12 in a vertical trim position, in which the driveshaft axis 19 is vertically oriented (i.e., parallel to vertical line V) and the propeller shaft axis 27 is parallel to the horizon. This is otherwise known as a level of neutral trim position. Referring to both FIGS. 1 and 5, a propulsion device 12 at this position encounters the most direct force from the water (see arrows W) that is still moving past the gearcase as the vessel 70 continues moving forward, which increases the chances of spinning the engine 14 backwards if the transmission 58 is shifted into reverse. As opposed to this position, the propulsion device 12 can be trimmed down in the direction of arrow D or trimmed up in the direction of arrow U (see also FIG. 6). This can be done by way of a trim device 62 (FIG. 1) such as a hydraulic trim cylinder in fluid communication with a pump-motor combination. One end of the trim device 62, such as a cylinder end, is coupled to the marine vessel transom 11 and the other end, such as the rod end, is coupled to the propulsion device 12. Signals from the controller 52 actuate the pump-motor combination to provide or remove hydraulic fluid from one side or the other of the hydraulic trim cylinder, thereby causing the trim device 62 to extend or retract as a piston within the cylinder moves the rod. As the trim device 62 extends or retracts, the propulsion device 12 is trimmed up or down with respect to the transom 11. One example of a hydraulic trim device is described in the above-incorporated U.S. Pat. No. 4,050,359; however, the trim device 62 could instead be an electrically or electro-hydraulically actuated piston-cylinder, or another type of device including but not limited to an electric linear actuator, rack and pinion, etc. The exact type of trim device 62 and its method of actuation are not limiting on the scope of the present disclosure, and because many trim devices are known to those having ordinary skill in the art, the trim device 62 will not be described more fully herein.

Through research and development, the present inventors realized that the situation in which the torque from the propeller 20 is so great that it slows the crankshaft down, stops it, and turns it the other way can be rectified by reducing the drag load of water W on the propeller 20, thereby reducing the reverse torque applied to the driveshaft 18 from the propeller shaft 22 via the gearset 28. The present inventors have realized that by trimming the propulsion device 12 up so that the propeller 20 is lifted out of the path of substantially perpendicular drag loads imposed by moving water W, this can help reduce or prevent ingestion of water by the engine 14 via the exhaust system by preventing reverse rotation of the crankshaft in the first place. Even if reverse rotation and ingestion of water cannot be altogether prevented, such as when the speed of the vessel before the panic shift was approximately 10-20 mph and the propulsion device 12 was trimmed down nearly to its lower limit, the present method has still been proven to load the alternator increasing resistance of crankshaft rotation against the loads from the propeller 20 to soften the impact if water is in fact ingested, which increases the probability that the engine 14 will survive without hydro-locking.

Figure 6:
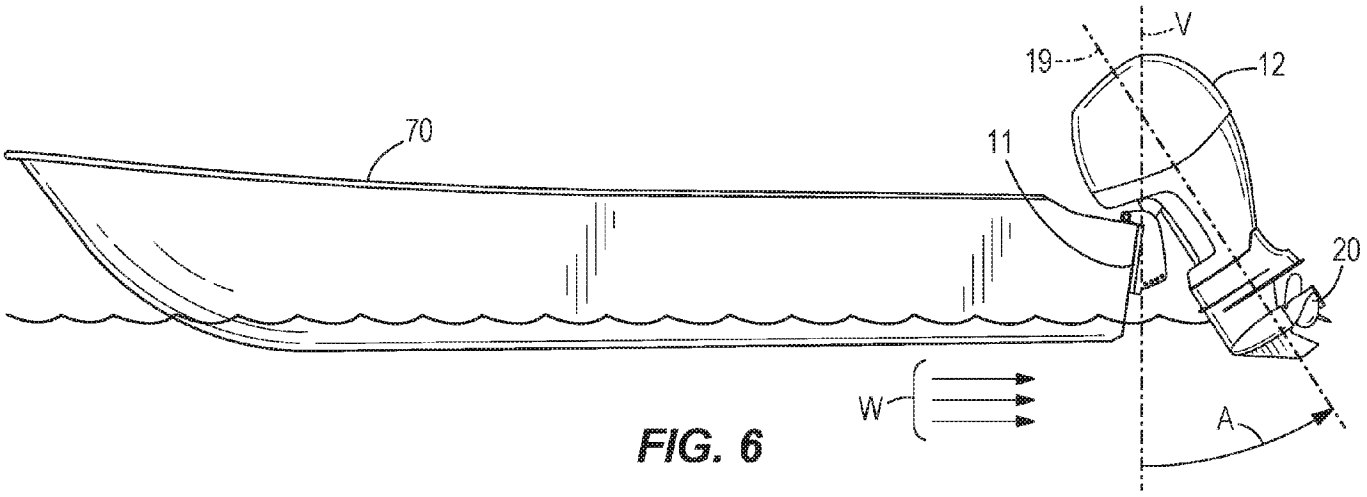
FIG. 6 illustrates a marine vessel with a propulsion device trimmed to a position above the vertical trim position.

Referring to FIG. 6, the present inventors have developed a system and method that will automatically trim the propulsion device 12 up in the event of a potentially harmful panic shift. For example, the propulsion device 12 can be trimmed up to a target trim position, for example a given angle A of the driveshaft axis 19 with respect to vertical (shown by dashed line V). By comparing FIG. 6 with FIG. 5, it can be seen that this trims the propulsion device 12 to a given amount above the vertical trim position, in which the driveshaft axis 19 was parallel to vertical V. The target angle A can be calibrated and saved in the memory 40 of the controller 52 or trim control unit 52*a*, or can be chosen by the operator via an input device. In other examples, the target angle A can be an angle that varies depending on the speed of the vessel 70. In still other examples, the given amount beyond the vertical trim position may be a predetermined amount calibrated (i.e., determined by testing) to lift the propeller 20 of the propulsion device 12 out of a path of substantially perpendicular drag loads imposed by water W in which the propulsion device 12 is operating. In another example, the given amount beyond the vertical trim position is an amount that increases with vessel speed, but is not less than the above-mentioned predetermined amount calibrated to lift the propeller 20 of the propulsion device 12 out of a path substantially perpendicular drag loads imposed by water W in which the propulsion device 12 is operating. As can be seen from FIG. 6, when the propulsion device 12 is trimmed to the target angle A, the water W will move somewhat under the propeller 20 rather than directly past it as in FIG. 5. This lessens the likelihood that the propeller 20 will spin fast enough to create torque that overcomes that applied to the engine's crankshaft by the engine 14.

Figure 7:
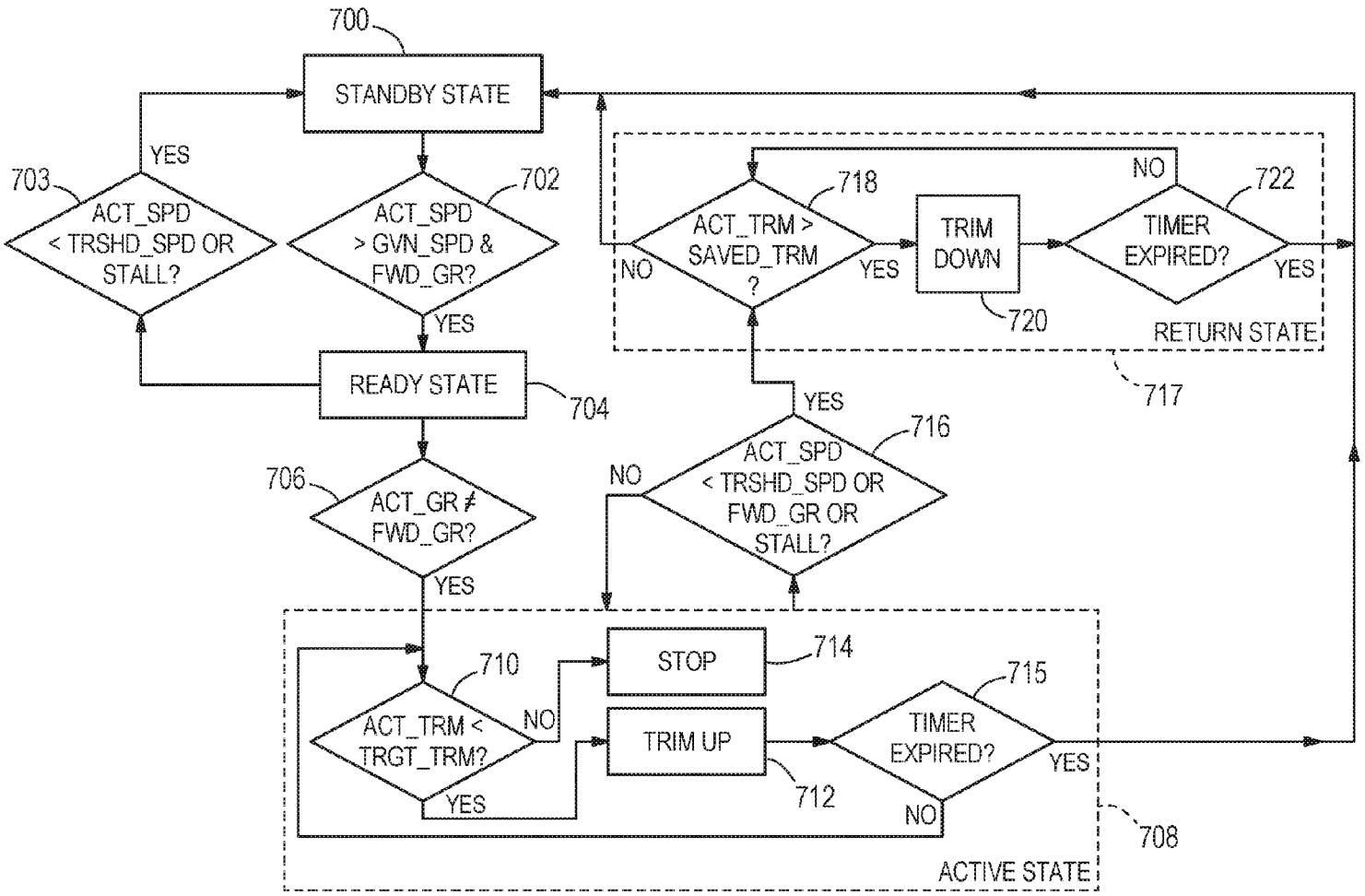
FIG. 7 illustrates one example of a stateflow diagram that can be used to carry out the method of the present disclosure.

According to the method of the present invention, the controller 52 uses determinations regarding speed and shift state to determine whether there is a possibility of a panic shift. For example, referring to both FIGS. 1 and 7, the controller 52 may begin by setting the trim control unit 52*a* to a standby state as shown at 700. The controller 52 may then determine if an actual speed is greater than a given speed and if a transmission 58 of the propulsion device 12 is in a forward gear, as shown at 702. The actual speed the controller 52 uses for comparison purposes may be a speed of the vessel 70 or a speed of the engine 14. If the controller 52 is programmed to use vessel speed, it compares the measured vessel speed (such as a GPS speed-over-ground reading from GPS 60 in FIG. 1, or a vessel speed measured using a pitot tube or paddle wheel sensor) to a calibrated speed in mph, kph, or similar. If the controller 52 is programmed to use engine speed, it compares the measured engine speed (determined for example using a tachometer 72, FIG. 1) to a calibrated speed in RPM. The shift state may be determined using a reading from the shift sensor 48 or from the position of the control lever 26 of the remote control 25, as described herein above.

If both the actual speed is greater than the given speed and the transmission 58 is in forward gear, the controller 52 may set the trim control unit 52*a* to a ready state as shown at 704. If the determination made at 702 is false, then the trim control unit 52*a* remains in the standby state. Placing the trim control unit 52*a* in the ready state only when the actual speed is greater than the given speed and the transmission 58 is in forward gear ensures that there truly is a possibility of a harmful panic shift and that the controller 52 does not unnecessarily perform the following steps. For example, it is when the vessel 70 has been travelling at high speeds (as determined by engine RPM or vessel speed) in forward gear that hydro-lock is possible in the event of a panic shift. At much lower forward speeds, it is less likely that the force of still forward-moving water would be enough to spin the propeller 20 such that torque on the propeller shaft 22 would overcome that on the crankshaft from the engine 14.

In one example, if while the trim control unit 52*a* is in the ready state, the controller 52 determines that the vessel or engine speed has dropped below a calibrated disable speed (i.e., is less than a threshold speed) or that the engine 14 has stalled, the controller 52 will cause the trim control unit 52*a* to exit the ready state (704) and enter the standby state (700) once again. Both of the standby state re-entry criteria are shown at 703. If the engine 14 has stalled, then hydro-lock may have already occurred or another issue is present that needs to be solved. If the vessel speed drops below a certain threshold, the boat may have slowed enough such that hydro-lock is no longer a concern. If the determination at 703 is false, then the trim control unit 52*a* remains in the ready state.

As shown at 706, the controller 52 next determines whether the transmission 58 has been shifted out of the forward gear while the trim control unit 52*a* is in the ready state 704, and if so, sets the trim control unit 52*a* to an active state 708. (If the transmission 58 has not been shifted out of forward gear, the trim control unit 52*a* remains in the ready state.) In the active state, as shown at 710, the controller 52 will compare an actual trim position of the propulsion device 12 (measured via a trim sensor 54 such as a Hall effect sensor, see FIG. 1) to a target trim position, in which the propulsion device 12 is trimmed up above a vertical trim position by a given amount (e.g., angle A). Compare FIGS. 5 and 6. As shown at 710, the controller 52 determines whether the actual trim position of the propulsion device 12 is less than the target trim position while the trim control unit 52*a* is in the active state, and if so, the controller 52 sends a signal to trim the propulsion device 12 up (i.e., in the direction of arrow U, FIG. 5) as shown at 712. In one example, the trim device 62 will trim the propulsion device 12 up until the actual trim position is equal to the target trim position. At this time, the controller 52 will determine that the actual trim position is not less than the target trim position, and will stop the trim up command, as shown at 714. By trimming up to the target trim position, at which the force of water W no longer acts directly perpendicular to the gearcase/propeller 20, the force on the propeller 20 is decreased, thereby decreasing the possibility of hydro-locking the engine 14.

In another example, the propulsion device 12 may be trimmed up until a trim-up timer has expired, even if the actual trim position has not reached the target trim position. See 715. If the timer has not expired, the controller 52 may continue by again determining if the actual trim position is less than he target trim position at 710. However, if the timer has expired, the system may return to the standby state 700. Such a trim-up timer that limits the time during which the controller 52 attempts to trim the propulsion device 12 up may be desirable in the case where there is a malfunction with the trim device 62, such as a leak in the fluid lines, or where the trim device 62 is not capable of raising the propulsion device 12 to the given angle A (see FIG. 6) for various other reasons. Even if the target trim position is not reached, the fact that the propulsion device 12 was trimmed up away from the vertical position at all will still lessen the drag loads imposed by water W, which otherwise would have acted perpendicular to the propeller 20.

Regardless of whether the target trim position has been reached or the timer has expired, the method may further include discontinuing sending the signal to trim the propulsion device 12 up and causing the trim control unit 52*a* to exit the active state (708) if at least one of the following is true: (1) an actual speed of the vessel 70 is less than a threshold vessel speed; (2) the engine 14 powering the propulsion device 12 has stalled; and (3) the transmission 58 has been shifted into the forward gear. This determination is shown at 716. In these situations, reverse-rotation of the engine 14 has already caused damage (e.g., the engine 14 has stalled) or is no longer a threat (e.g., the vessel 70 is moving slowly or the selector clutch 30 is engaged with the forward gear 34). An arrow is shown extending directly from the box 708 denoting the active state to the determination at 716 because the controller 52 can choose to exit the active state 708 at any time if one of these conditions is true, not merely after one of the sub-steps at 710, 712, 714, or 715 has been performed or determined.

The method may also include saving the actual trim position of the propulsion device 12 as a saved trim position upon setting the trim control unit 52*a* to the active state. If this is done, after exiting the active state (see 716), the method may include setting the trim control unit 52*a* to a return state 717, where the controller 52 automatically sends a signal to trim the propulsion device 12 to the saved trim position in response to the trim control unit 52*a* exiting the active state. This may be desirable so that after the panic shift event is over, the propulsion device 12 will return to its previous trim position at which it was positioned before the panic shift occurred. This removes the need for the operator to press a button to trim the propulsion device 12 back to where he or she had it before. In another example, the saved trim position might not be the position that the operator set prior to the panic shift, but might instead be a trim position that is optimal for boat launch, as it may be necessary to re-launch the boat if it has slowed significantly during the panic shift.

While in the return state 717, for example, the controller 52 may determine if the actual trim position is greater than the saved trim position as shown at 718. If so, the controller 52 may send a signal to trim the propulsion device 12 down, as shown at 720. The propulsion device 12 may be trimmed down until a trim-down timer has expired, see 722, even if the actual trim position has not reached the saved trim position. Again, returning the trim control unit 52*a* to the standby state 700 in this instance prevents the controller 52 from commanding the trim device 62 to achieve a trim position it is unable to achieve. Alternatively, if the trim-down timer has not expired, the controller 52 may continually trim the propulsion device 12 down until the actual trim position is not greater than the saved trim position. Once the saved trim position is achieved as determined at 718, the controller 52 may set the trim control unit 52*a* back to the standby state 700.

By performing the above-described method with the above-described system, including a trim device 62 having a first end coupled to the propulsion device 12 and a second end coupled to the transom 11, the trim device being extendible and retractable to trim the propulsion device 12 up and down with respect to the transom 11; a speed sensor 60 or 72 sensing an actual speed representing one of a speed of the vessel 70 and a speed of an engine 14 powering the propulsion device 12; a shift sensor 48 sensing a gear state of a transmission 58 of the propulsion device 12; a trim sensor 54 sensing an actual trim position of the propulsion device 12; and a controller 52 in signal communication with the trim device, the speed sensor, the shift sensor, and the trim sensor, and having a trim control unit 52*a* controlling extension and retraction of the trim device, the present disclosure provides a way to prevent or at least lessen the likelihood of hydro-lock in the event of a panic shift.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

What is claimed is:

1. A method for positioning a marine propulsion device with respect to a transom of a marine vessel to which it is coupled, the method comprising:

comparing with a controller an actual speed representing one of a speed of the vessel and a speed of an engine powering the propulsion device with a given speed and determining with the controller whether a transmission of the propulsion device is in a forward gear;

setting a trim control unit of the controller to a ready state in response to the actual speed being greater than the given speed and the transmission being in the forward gear;

setting the trim control unit to an active state in response to the transmission being shifted out of the forward gear while the trim control unit is in the ready state;

sending a signal with the controller to trim the propulsion device up in response to an actual trim position of the propulsion device being less than a target trim position while the trim control unit is in the active state; and trimming the propulsion device up with a trim device in response to the signal to trim the propulsion device up.

2. The method of claim 1, wherein the target trim position is one in which the propulsion device is trimmed up above a vertical trim position by a given amount.

3. The method of claim 2, further comprising sending the signal to trim the propulsion device up until the actual trim position is equal to the target trim position.

4. The method of claim 3, further comprising:

discontinuing sending the signal to trim the propulsion device up and causing the trim control unit to exit the active state if at least one of the following is true:

the actual speed of the vessel is less than a threshold vessel speed;

the engine powering the propulsion device has stalled; and the transmission has been shifted back into the forward gear.

5. The method of claim 4, further comprising saving the actual trim position of the propulsion device as a saved trim position upon setting the trim control unit to the active state.

6. The method of claim 5, further comprising automatically sending a signal to trim the propulsion device to the saved trim position in response to the trim control unit exiting the active state.

7. The method of claim 4, further comprising automatically sending a signal to trim the propulsion device down until a trim-down timer has expired in response to the trim control unit exiting the active state.

8. The method of claim 2, further comprising sending the signal to trim the propulsion device up until a trim-up timer has expired, even if the actual trim position has not reached the target trim position.

9. The method of claim 2, wherein the given amount is an amount calibrated to lift a propeller of the propulsion device out of a path of substantially perpendicular drag loads imposed by water in which the propulsion device is operating.

10. The method of claim 2, wherein the given amount is an amount that increases with vessel speed, but is not less than an amount calibrated to lift a propeller of the propulsion device out of a path of substantially perpendicular drag loads imposed by water in which the propulsion device is operating.

11. The method of claim 1, further comprising determining with the controller if the actual speed of the vessel is less than a threshold vessel speed while the trim control unit is in the ready state, and if so, setting the trim control unit to a standby state.

12. A system for positioning a marine propulsion device with respect to a transom of a marine vessel to which it is coupled, the system comprising:

a trim device having a first end coupled to the propulsion device and a second end coupled to the transom, the trim device being extendible and retractable to trim the propulsion device up and down with respect to the transom;

a speed sensor sensing an actual speed representing one of a speed of the vessel and a speed of an engine powering the propulsion device;

a shift sensor sensing a gear state of a transmission of the propulsion device;

a trim sensor sensing an actual trim position of the propulsion device; and a controller in signal communication with the trim device, the speed sensor, the shift sensor, and the trim sensor, and having a trim control unit controlling extension and retraction of the trim device;

wherein the controller sets the trim control unit to a ready state in response to the actual speed being rater than a given speed and the transmission is being in a forward gear;

wherein the controller sets the trim control unit to an active state in response to the transmission being shifted out of the forward gear while the trim control unit is in the ready state;

wherein the controller sends a signal to the trim device to trim the propulsion device up in response to the actual trim position being less than a target trim position while the trim control unit is in the active state; and wherein the trim device thereafter trims the propulsion device up in response to the signal to trim the propulsion device up.

13. The system of claim 12, wherein the target trim position is one in which the propulsion device is trimmed up above a vertical trim position by a given amount.

14. The system of claim 13, wherein the controller sends the signal to the trim device to trim the propulsion device up until the actual trim position is equal to the target trim position.

15. The system of claim 14, wherein the controller discontinues sending the signal to the trim device to trim the propulsion device up and causes the trim control unit to exit the active state if at least one of the following is true:

the actual speed of the vessel is less than a threshold vessel speed;

the engine powering the propulsion device has stalled; and the transmission has been shifted into the forward gear.

16. The system of claim 15, further comprising a memory in which the controller saves the actual trim position of the propulsion device as a saved trim position upon setting the trim control unit to the active state.

17. The system of claim 16, wherein the controller automatically sends a signal to the trim device to trim the propulsion device down until the actual trim position is equal to the saved trim position in response to the trim control unit exiting the active state.

18. The system of claim 13, wherein the controller sends the signal to the trim device to trim the propulsion device up until a trim-up timer has expired, even if the actual trim position has not reached the target trim position.

19. The system of claim 13, wherein the given amount is an amount calibrated to lift a propeller of the propulsion device out of a path of substantially perpendicular drag loads imposed by water in which the propulsion device is operating.

20. The system of claim 12, wherein the speed sensor comprises a global positioning system that senses a vessel speed over ground.

* * * * *